United States Patent [19]

Cummings

[11] 4,035,409

[45] July 12, 1977

[54] HYDROCARBYL AMINE SUBSTITUTED PROPIONIC ESTER

[75] Inventor: William M. Cummings, Fishkill, N.Y.

[73] Assignee: Texaco Inc., New York, N.Y.

[21] Appl. No.: 585,016

[22] Filed: June 9, 1975

Related U.S. Application Data

[62] Division of Ser. No. 533,909, Dec. 18, 1974, Pat. No. 3,926,578.

[51] Int. Cl.[2] ..... C07C 101/18

[52] U.S. Cl. ..... 260/479 S; 260/482 R

[58] Field of Search ..... 260/482 R, 479 S

[56] References Cited

U.S. PATENT DOCUMENTS

| | | | |
|---|---|---|---|
| 2,468,012 | 4/1949 | Isbell | 260/482 R |
| 2,787,633 | 4/1957 | Harrison | 260/482 R |
| 3,419,525 | 12/1968 | Aelony | 260/482 R |

FOREIGN PATENT DOCUMENTS

| | | | |
|---|---|---|---|
| 554,951 | 3/1958 | Canada | 260/482 R |
| 567,251 | 12/1958 | Canada | 260/482 R |
| 569,882 | 2/1959 | Canada | 260/482 R |

*Primary Examiner*—Lorraine A. Weinberger
*Assistant Examiner*—Michael Shippen
*Attorney, Agent, or Firm*—Thomas H. Whaley; Carl G. Ries; James J. O'Loughlin

[57] ABSTRACT

Hydrocarbylamine substituted propionic esters represented by the formula:

$$RR'NCH_2CH_2COOR''$$

in which R is an aliphatic hydrocarbon radical having from 12 to 22 carbon atoms, R′ is hydrogen or a lower alkyl radical having from 1 to 2 carbon atoms and R″ is a hydrocarbon radical having from about 8 to 22 carbon atoms, and a motor fuel composition containing said esters.

4 Claims, No Drawings

HYDROCARBYL AMINE SUBSTITUTED PROPIONIC ESTER

This is a division of application Ser. No. 533,909, filed Dec. 18, 1974, now U.S. Pat. No. 3,926,578.

BACKGROUND OF THE INVENTION

FIELD OF THE INVENTION

Modern internal combustion engine design is undergoing important changes to meet new Federal standards concerning engine exhaust gas emissions. A major change in engine design recently adopted is the feeding of blow-by gases from the crankcase zone of the engine into the intake air supply of the carburetor rather than venting these gases to the atmosphere as in the past. A further change being adopted involves the recycling of a part of the exhaust gases to the combustion zone of the engine in order to effect a more complete combustion and to further reduce objectionable exhaust emissions. The recycled exhaust gases contain substantial amounts of deposit-forming substances which promote the formation of deposits in and around the throttle plate area of the carburetor. These deposits have the effect of restricting the flow of air through the carburetor at idle and at low speeds so that an over-rich fuel mixture results. This condition produces rough engine idling and stalling and serves to increase the harmful exhaust emissions which the engine design changes were intended to overcome.

Modern gasoline compositions are very highly refined products. Despite this they contain minor amount of impurities which can promote corrosion during the period that the bulk fuel is being transported and stored and also in the fuel tank, fuel lines and carburetor of the motor vehicle. An acceptable motor fuel must contain an effective and compatible inhibitor to inhibit or prevent corrosion during transport and prior to its use in the engine.

SUMMARY OF THE INVENTION

A class of hydrocarbyl amine substituted esters of propionic acid has been discovered which are effective as detergents and corrosion inhibitors when employed in a liquid hydrocarbon fuel for an internal combustion engine. These compounds, which are characterized by having two relatively long hydrocarbyl groups namely a hydrocarbylamine substituent and an ester substituent, appear to be unique in their carburetor detergency and corrosion inhibiting properties.

DESCRIPTION OF THE PREFERRED EMBODIMENTS

The hydrocarbylamine substituted ester of propionic acid is represented by the formula:

$$RR'NCH_2CH_2COOR''$$

in which R is a saturated hydrocarbon radical of about 12 to 22 carbon atoms, R′ is hydrogen or a lower alkyl radical having from 1 to 2 carbon atoms and R″ is a hydrocarbon radical having from about 8 to 22 carbon atoms.

A preferred hydrocarbylamine substituted ester of propionic acid is one conforming to the above formula in which R is an aliphatic hydrocarbon radical having from about 16 to 18 carbon atoms, R′ is hydrogen and R″ is an alkyl substituted phenyl radical represented by the formula:

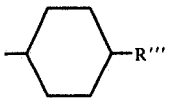

in which R‴ is an alkyl radical having from about 8 to 12 carbon atoms.

The prescribed hydrocarylamine substituted ester of propionic acid is prepared by reacting approximately equal mole amounts of an aliphatic amine, acrylic acid and an alcohol or hydroxy compound. In general, the reaction is conducted in two steps. In the first step equivalent amounts of the alcohol and acrylic acid are combined in a suitable hydrocarbon or inert solvent, such as xylene and heated to reflux temperature in the presence of an effective esterification catalyst such as p-toluene sulphonic acid. This reaction is continued until the stoichimetrical amount of water has been collected. In the second step, an equivalent amount of a hydrocarbylamine is added and the reaction temperature held at a temperature of about 120° C. These reaction conditions are continued for sufficient time to permit the addition of the hydrocarbylamine to the propionic acid ester. The solvent is then removed by distillation for recovery of the desired product.

Examples 1 to 4 below illustrate the preparation of hydrocarbyl acrylates which is the first step in the preparation of hydrocarbylamino alkyl propionate.

EXAMPLE 1

DODECYLPHENYLACRYLATE

To 256 g of dodecylphenol in 1000 ml of xylene is added 144 g acrylic acid (AA), 2.0 g hydroquinone (HQ) and 15.0 g p-tolunesulfonic acid (PTSA). This mixture is heated at reflux (140° C) for 11 hours while the water of reaction is collected (≈20 ml). The reaction mixture is cooled, and the xylene removed under reduced pressure to give ≈400 g dodecyl phenylacrylate. The analytical data for this acrylate are shown below:

| Ratio Acrylic Acid/ Dodecyl Phenol | | SAP.[1] No. | Neut.[2] No. | TAN[3] | M.W.[4] |
|---|---|---|---|---|---|
| 1. | 1:1 | 140 | | 20.5 | 262 |
| 2. | 1.5:1 | 193 | 52.8 | | 291 |
| 3. | 2:1 | 221.8 | 66.5 | | |
| 4. | 2:1 | 208 | 68.1 | | |

[1]Saponification number
[2]Neutralization number
[3]TAN = Total acid number
[4]M.W. = Molecular weight

EXAMPLE 2

$C_{20-22}$ N-ALKYL ACRYLATE

To 300 g of $C_{20-22}$ n-alkyl alcohol in 300 ml xylene is added 72 g AA, 0.3 g HQ and 30 g PTSA. This reaction mixture is heated for 12 hours at reflux (≈140°)while the water of reaction is collected (≈17.5 ml). The reaction mixture is cooled, and the xylene removed under reduced pressure to give 329 g $C_{20-22}$ n-alkylacrylate. The analytical data for this acrylate is shown below:

| Prep. No. | SAP No. | Neut. No. |
|---|---|---|
| 5. | 98.5 | 2.91 |
| 6. | 110.6 | 5.04 |
| 7. | 132 | 0 |
| 8. | 116.0 | 5.04 |

EXAMPLE 3

ISODECYL ACRYLATE

To 157 g isodecyl alcohol in 200 ml xylene is added 117 g AA, 1.0 g HQ and 2.0Q PTSA. The reaction mixture is heated for 2 hrs. at reflux (~140° C) while the water of reaction is collected (17 ml). The reaction mixture is cooled and the xylene removed under reduced pressure to give 250 g isodecyl acrylate. The analytical data for this acrylate is shown below.

| Prep. No. | SAP No. | Neut. No. |
|---|---|---|
| 9. | 270 | 11.5 |
| 10. | 273 | |

EXAMPLE 4

PHENOXY (POLYETHOXY) ETHYL ACRYLATE

To 58.6 g of phenoxy (polyethoxy)$_{4-5}$ ethanol* in 60 ml xylene is added 14.4 g AA, 0.2 g HQ and 20 g PTSA. This mixture is heated to the reflux point (~140° C) for 5 hrs. while the water of reaction is collected (~3.0 ml). The reaction mixture is cooled and the xylene removed to give 65 g of penoxy (polyethoxy) ethyl acrylate.

| Prep. No. | SAP No. | Neut. No. |
|---|---|---|
| 11. | 136 | 20.4 |

*Tritonyl 45 is a phenoxy (polyethoxy) ethanol made by Rohm and Haas containing 4–5 ethoxy groups.

The following examples illustrate the second step in the process for producing hydrocarbylamino alkyl propionates by reacting a hydrocarbylamine with the alkyl acrylate of step 1.

EXAMPLE 5

2-(TALLOWAMINE) DODECYL PHENYL PROPIONATE

To 62.2 g dodecyl phenyl acrylate in 100 ml xylene is added 54 g tallowamine (Armeen T) and this mixture is heated at 120° C for 3 hours. The xylene is removed under reduced pressure to give 116 g of product. The analysis and test results for this material are shown below:

| Analysis | Prep. No. 12 | Prep. No. 13 | Prep. No. 14 | Prep. No. 15 |
|---|---|---|---|---|
| TBN-ST-312 | 45.6 | 46.7 | 45.6 | 43.9 |
| SAP No. | 47.8 | 49.2 | 63.7 | 18.5 ck 25.9 |
| Neut. No. | 36.8 | 43.5 | 49.5 | 2.48 ck 21.8 |
| TAN | 37.5 | | 43.9 | |
| OH | 122 | 119 | 139 | 136 |
| % N | 1.33 | 2.3 | *no solvent | 2.4 |
| Sp. Gr. | 0.948 | | used in the | |

-continued

| Analysis | Prep. No. 12 | Prep. No. 13 | Prep. No. 14 | Prep. No. 15 |
|---|---|---|---|---|
| | | | reaction | |

EXAMPLE 6

2($C_{15-20}$ sec. ALKYL AMINO) $C_{20-22}$ N-ALKYL PROPIONATE

To 70 g of $C_{20-22}$ n-alkyl acrylate is added 46 g $C_{15-20}$ secondary alkyl amine (Armeen L-15) and this mixture heated for 4 hrs. at 150° C. The analysis and test results for this material are shown below:

| Analysis | Prep. No. 16 | Prep. No. 17 |
|---|---|---|
| TBN | 62 | 78.4 |
| SAP No. | 44 | 30.9 |
| % N | 3.4 | 1.9 |
| Mole Wt. | 635 | — |

EXAMPLE 7

2($C_{15-20}$ SECONDARY ALKYL AMINO) ISODECYL PROPIONATE

To 38.8 isodecyl acrylate is added 67 g $C_{15-20}$ secondary alkyl amine (Armeen L-15) and this mixture is heated for 1 hr. at 120° C. The analysis and test results for this material are shown below:

| Analysis | Prep. No. 18 |
|---|---|
| TBN | 102.8 |
| SAP No. | 54.9 |

EXAMPLE 8

2(TALLOWAMINO) PHENOXY (POLYETHOXY) ETHYL PROPIONATE

To 44.8 g of phenoxy (polyethoxy) ethyl acrylate in 70 ml xylene is added 34.0 tallowamine (Armeen T) and this mixture is heated at 120° C for 4 hours. The xylene is removed under reduced pressure. The analysis and test results for this 2(tallowamino) phenoxy (polyethoxy)$_{4-5}$ ethyl propionate is given below:

| Analysis | Run No. 19 |
|---|---|
| TBN | 54.9 |
| SAP No. | 50.0 |
| Neut. No. | 12.8 |

The following table lists representative examples of hydrocarbyl amine substituted propionic esters of the invention:

2-($C_{15-20}$ secondary alkyl amine) isodecyl propionate
2-($C_{12-14}$ secondary alkyl amine) isodecyl propionate
2-(cocoamine) isodecyl propionate
2-(tallowamino) isodecyl propionate
2 -(methyl $C_{15-20}$ secondary alkyl) amino isodecyl propionate
2-($C_{15-20}$ secondary alkyl) dodecyl phenyl propionate
2-($C_{12-14}$ secondary alkyl dodecyl phenyl propionate)
2-(cocoamine) dodecyl phenyl propionate
2-(tallowamine) dodecyl phenyl propionate 2-(methyl $C_{15-20}$ secondary alkyl amino) dodecylphenyl propionate
2-($C_{15-20}$ secondary alkyl) - $C_{20-22}$ n-alkyl propionate
2-($C_{12}$–secondary alkyl) - $C_{20-22}$ n-alkyl propionate
2-(cocoamine) -$C_{20-22}$-n-alkyl propionate
2-(tallowamino)-$C_{20-22}$ -n-alkyl propionate
2-(methyl $C_{15-20}$ secondary alkyl amino) $C_{20-22}$ -n-alkyl propionate
2-($C_{15-20}$ secondary alkyl amino) hexadecyl propionate
2-($C_{12-14}$ secondary alkylamino) hexadecyl propionate
2-(cocoamino) hexadecyl propionate
2-(tallowamino) hexadecyl propionate
2-(methyl $C_{15-20}$ secondary alkyl) hexadecyl propionate The prescribed hydrocarbylamine ester of the invention is employed in a gasoline motor fuel composition in a concentration to provide both effective carburetor detergency and corrosion inhibiting properties. In general, an effective concentration of the additive ranges from about 0.001 to 0.1 weight percent with a preferred concentration ranging from about 0.01 to 0.075 weight percent. The limits of the preferred range correspond respectively to about 25 and 200 PTB (pounds of additive per 1000 barrels of gasoline).

Any gasoline suitable for a spark-ignited, internal combustion engine can be used in the practice of this invention. In general, the base fuel will consist of a mixture of hydrocarbons in the gasoline boiling range, i.e., boiling from about 75° to 450° F. The hydrocarbon components can consist of paraffinic, naphthenic, aromatic and olefinic hydrocarbons. This gasoline can be obtained naturally or it can be produced by thermal or catalytic cracking and/or reforming of petroleum hydrocarbons. The base fuel will generally have a Research Octane Number above 80 and up to 102 with the preferred range being from about 85 to 100.

The prescribed hydrocarbylamine ester additive of the invention was tested for its corrosion inhibiting properties in gasoline in the Colonial Pipeline Rust Test described below:

COLONIAL PIPELINE RUST TEST

A steel spindle, 3 3/16 inches long and ½inch wide, made from ASTM D-665-60 steel polished with Crystal Bay fine emery paper, is used in the Colonial Pipeline Rust Test. The spindle is placed in a 400cc beaker with 300cc of fuel sample, which is maintained at 100° F. for one-half hour. Then 30cc of distilled water is added. The beaker and contents are kept at 100° F. for 3½hours. The spindle thereafter visually inspected and the percentage of rusted surface area is estimated.

The Base Fuel designated Base Fuel A, employed in the following examples was a premium grade gasoline having a Research Octane Number of about 100 and contained 3 cc. of tetraethyl lead per gallon. This gasoline consisted of about 25 percent aromatic hydrocarbons, 10 percent olefinic hydrocarbons and 65 percent paraffinic hydrocarbons and boiled in the range from about 90° F to 380° F.

The results of this test are set forth in Table I below.

TABLE I

| COLONIAL PIPELINE RUST TEST | | | % Rust |
|---|---|---|---|
| 1. | Base Fuel A alone | | 75 |
| 2. | Base Fuel A + 7.5 PTB[1] | Prep. No. 12 | 0.1 – 1 |

TABLE I-continued

| COLONIAL PIPELINE RUST TEST | | | % Rust |
|---|---|---|---|
| 3. | Base Fuel A + 7.5 PTB | Prep. No. 13 | 0.1 |
| 4. | Base Fuel A + 7.5 PTB | Prep. No. 14 | 0.1 |
| 5. | Base Fuel A + 15 PTB | Prep. No. 13 | 0.1 |
| 6. | Base Fuel A + 20 PTB | Prep. No. 18 | 15 |

[1]PTB = Pounds of additive per 1000 gallons of gasoline.

CHEVROLET CARBURETOR DETERGENCY TEST

This test is run on a Chevrolet V-8 engine mounted on a test stand using a modified four-barrel carburetor. The two secondary barrels of the carburetor are sealed and the feed to each of the primary barrels arranged so that separate fuels can be run in each barrel simultaneously. The primary carburetor barrels are also modified so that they have removable aluminum inserts in the throttle plate area in order that deposits formed on the inserts in this area can be conveniently weighed.

In the procedure designed to determine the effectiveness of an additive fuel to remove preformed deposits in the carburetor, the engine is run for a period of time, usually 24 to 48 hours, using the base fuel as the feed to both barrels with engine blow-by circulated to the air inlet of the carburetor. The weight of the deposits on both sleeves is determined and recorded. The engine is then cycled for 24 additional hours with a reference fuel being fed to one barrel, additive fuel to the other, and no blow-by to the carburetor air inlet. The reference fuel contains 15 PTB of a carburetor detergent. The inserts are then removed from the carburetor and weighed to determine the difference between the performance of the additive and non-additive fuels in removing the preformed deposits. After the aluminum inserts are cleaned, they are replaced in the carburetor and the process repeated with the fuels reversed in the carburetor to minimize differences in fuel distribution and barrel construction. The effectiveness of the additive fuel is expressed as the difference ($\Delta$) between deposit removed by the additive fuel and the deposit removed by base fuel. When $\Delta$ is positive, the additive fuel has removed more deposit than the reference fuel.

The motor fuel used as a standard for comparison purposes in this test is a commercial high octane premium gasoline containing a highly effective carburetor detergent. The fuel composition representative of the invention consisted of Base Fuel A described above containing the indicated amounts of the additive of the invention. The results of this test are reported as the difference in carburetor deposits removed by the additive containing gasoline of the invention in comparison to the commercial premium detergent gasoline.

The results of the Chevrolet Carburetor Detergency Test are set forth in Table II below.

TABLE II

| CHEVROLET CARBURETOR DETERGENCY TEST | | | |
|---|---|---|---|
| Run | Fuel | | % Deposit Removed |
| 7. | Base Fuel A + 7.5 | PTB Prep. No. 12 | – 7 |
| 8. | Base Fuel A + 10 | PTB Prep. No. 12 | + 21 |
| 9. | Base Fuel A + 15 | PTB Prep. No. 16 | + 19 |

The foregoing tests demonstrate the outstanding corrosion inhibiting and improved carburetor detergency properties of the fuel composition of the invention.

This novel fuel composition is particularly suitable for maintaining the cleanliness and low exhaust emission from a modern internal combustion gasoline engine.

I claim:

1. A hydrocarbylamine substituted propionic ester represented by the formula:

$$RR'NCH_2CH_2COOR''$$

in which R is an aliphatic hydrocarbon radical having from 16 to 18 carbon atoms, R′ is hydrogen and R″ is an alkyl substituted phenyl radical having from 14 to 20 carbon atoms.

2. The compound 2-l -(tallowamino) dodecyl phenyl propionate.

3. The compound 2($C_{15-20}$ sec. alkyl amino) $C_{20-22}$ n-alkyl propionate.

4. The compound 2($C_{15-20}$ secondary alkylamino) isodecyl propionate.

* * * * *